United States Patent [19]

Fisher, Jr.

[11] 4,428,576

[45] Jan. 31, 1984

[54] SUSPENDED CYCLE RIDING DEVICE

[76] Inventor: James L. Fisher, Jr., 4510 N. Hughes, Fresno, Calif. 93705

[21] Appl. No.: 325,830

[22] Filed: Nov. 30, 1981

[51] Int. Cl.[3] ..... A63G 1/12; A63G 1/28

[52] U.S. Cl. ..... 272/33 R

[58] Field of Search ..... 272/33 R, 33 B, 36, 272/40, 41, 42, 28, 130, 73

[56] References Cited

U.S. PATENT DOCUMENTS

| | | | |
|---|---|---|---|
| 510,747 | 12/1893 | Weston | 272/33 R |
| 540,127 | 5/1895 | Weston | 272/33 R |
| 548,450 | 10/1895 | Norcross | 272/33 R |
| 563,793 | 7/1896 | Nickerson . | |
| 575,624 | 1/1897 | Weston | 272/33 R |
| 1,643,097 | 9/1927 | Stewart et al. | 272/33 R |
| 2,537,176 | 1/1951 | Vlahov | 272/33 R |
| 2,730,366 | 1/1956 | Etherington . | |
| 3,192,872 | 7/1965 | Parent . | |
| 3,443,664 | 5/1969 | Frassanito et al. | 272/73 X |
| 3,494,616 | 2/1970 | Parsons | 272/130 X |

*Primary Examiner*—Robert A. Hafer
*Assistant Examiner*—Arnold W. Kramer
*Attorney, Agent, or Firm*—Huebner & Worrel

[57] ABSTRACT

A suspended cycle riding device having an upright column; an arm extended across and rotationally mounted on the upper end of the column; a pair of cycle frames individually suspended at their upper portions from the opposite ends of the arm by a pivot for centrifugally urged movement of the frame outwardly of the column as the arms and the frames rotate about the column; elements for limiting such pivotal movement and for supporting the frame on the arm in the event of failure of the pivot; a seat and a set of pedals on each frame for an operator; a hydraulic drive from the pedals for rotationally driving the arm and frames about the column, the drive substantially preventing rotation of each pedal set when it is not being pedaled.

7 Claims, 4 Drawing Figures

SUSPENDED CYCLE RIDING DEVICE

BACKGROUND OF THE INVENTION

1. Field of the Invention

The present invention relates to a suspended cycle riding device, and more particularly to such a device having one or more cycle frames suspended from a horizontal arm pivotally mounted at its center on a column, the arm together with the frames being rotationally driven by an occupant about the column by sets of pedals individual to the frames.

2. Description of the Prior Art

The prior art includes cycle-like devices for use with a stationary elevated track. Each such device has an upper portion, which is mounted on the track by wheels above the track, and a lower portion which is suspended from the upper portion and is provided with a seat and pedals. The pedals are connected in driving relation to one of the wheels by a bicycle-like chain drive to motivate the device along the track. The track may be circular with a plurality of the devices mounted on the track and connected for movement thereabout in fixed, spaced relation. Insofar as is known to the applicant, the drive mechanism of each such prior art pedal-motivated device is independent of such mechanism of other devices utilized on the same track, no provision being made for a cooperative drive of a plurality of the devices which allows the connected devices to be independently pedaled or which allows the connected devices to move under their inertia without the pedals being rotated while such inertia is dissipated.

While such prior art devices together with their tracks appear effective, the applicant is aware of none that have come into commercial use. It is apparent that a track formed by a cable would have successive up and down grades due to the catenary curve of the cable between adjacent supports. On the other hand, a fixedly supported and rigid horizontal track would be relatively expensive. With a track of either type the danger exists of one of the devices becoming detached and falling from the track. It is also evident that the use of a chain drive in a device which is exposed to weather, as playground equipment, would require substantial maintenance and would present the danger of entanglement in each chain of such drive. The above mentioned dangers are, of course, greater when a device is used by a child.

PRIOR ART STATEMENT

The following patents, copies of which are enclosed, are submitted in conformance with 37 C.F.R. Sections 1.97 and 1.98 and characterize the closest prior art of which the applicant is aware.

Nickerson: U.S. Pat. No. 563,793: July 14, 1896
Etherington: U.S. Pat. No. 2,730,366: Jan. 10, 1956
Parent: U.S. Pat. No. 3,192,872: July 6, 1965

The Nickerson U.S. Pat. No. 563,793 and the Parent U.S. Pat. No. 3,192,872 are believed relevant in their disclosure of devices having a suspended cycle-like frame motivated by pedals.

The Etherington U.S. Pat. No. 2,730,366 is believed relevant in its disclosure of a plurality of such devices mounted on a circular track and connected in spaced relation for movement therealong in a circular path.

SUMMARY OF THE INVENTION

It is an object of the present invention to provide an improved suspended cycle riding device.

Another object is to provide such a device which is sturdy and economical in construction, and which requires relatively little maintenance, even when exposed to the weather and/or vigorously utilized.

Another object is to provide such a device for use by a plurality of operators, each having pedals independently actuatable to operate the device.

Another object is to provide such a device where any or all of the operators can cease pedaling with the pedals of such operators remaining stationary while other portions of the device continue to move by inertia.

Another object is to provide such a device which provides a sensation of centrifugal force similar to that of a conventional bicycle in a turn.

Another object is to provide such a device wherein danger due to excessive deviation from the usual path due to centrifugal force is obviated.

Another object is to provide such a device wherein the drive from the pedals is efficient.

Another object is to provide such a device wherein the device moves in a substantially horizontal path without the use of a relatively expensive track structure.

A further object is to provide improved elements and arrangements thereof in a suspended cycle device which achieves the foregoing and other objects, is safe and enjoyable to operate, and is fully effective in carrying out its intended purposes.

DESCRIPTION OF THE PREFERRED EMBODIMENT

Figure 1:
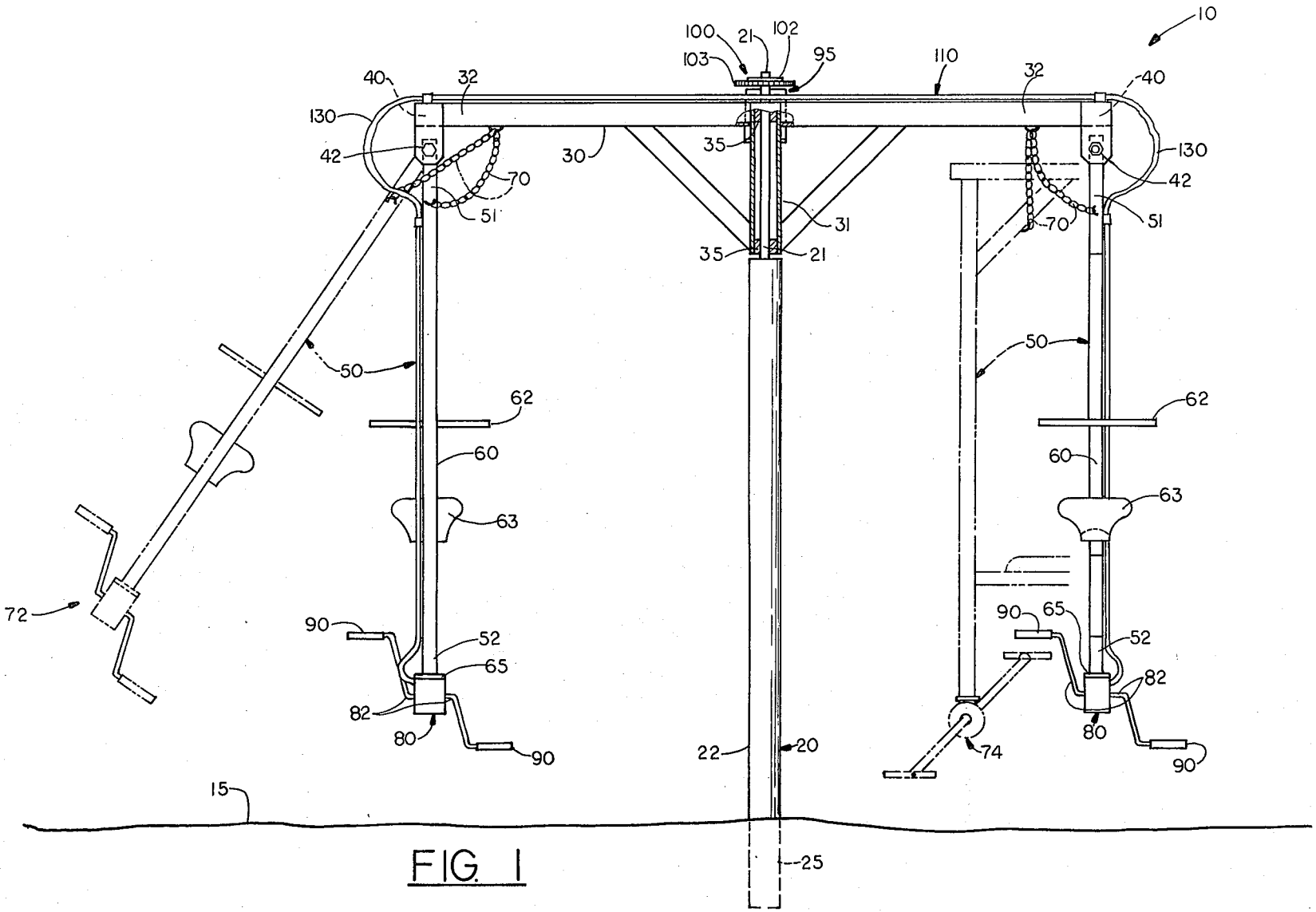
FIG. 1 is an elevation of a suspended cycle amusement device embodying the principles of the subject invention, portions of the device being broken away to show bearings utilized therein and alternate positions of cycle frames being represented in dash-dot lines.
Figure 3:
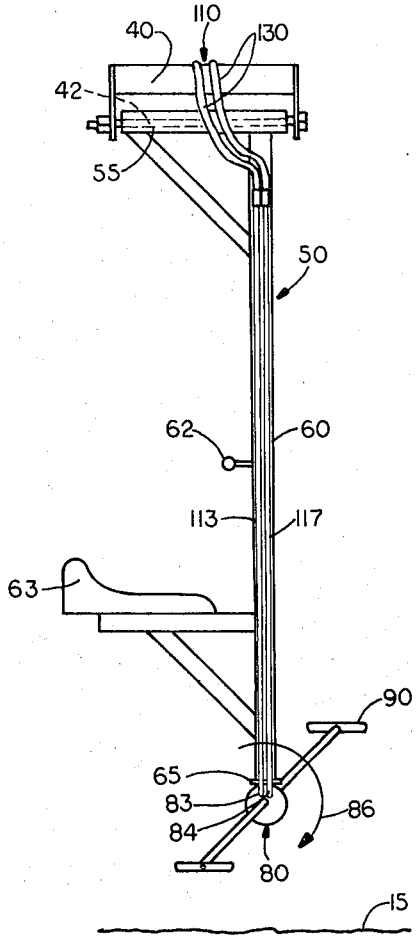
FIG. 3 is an elevation of a portion of the device from a position at a right angle to the position of FIG. 1.
Figure 2:
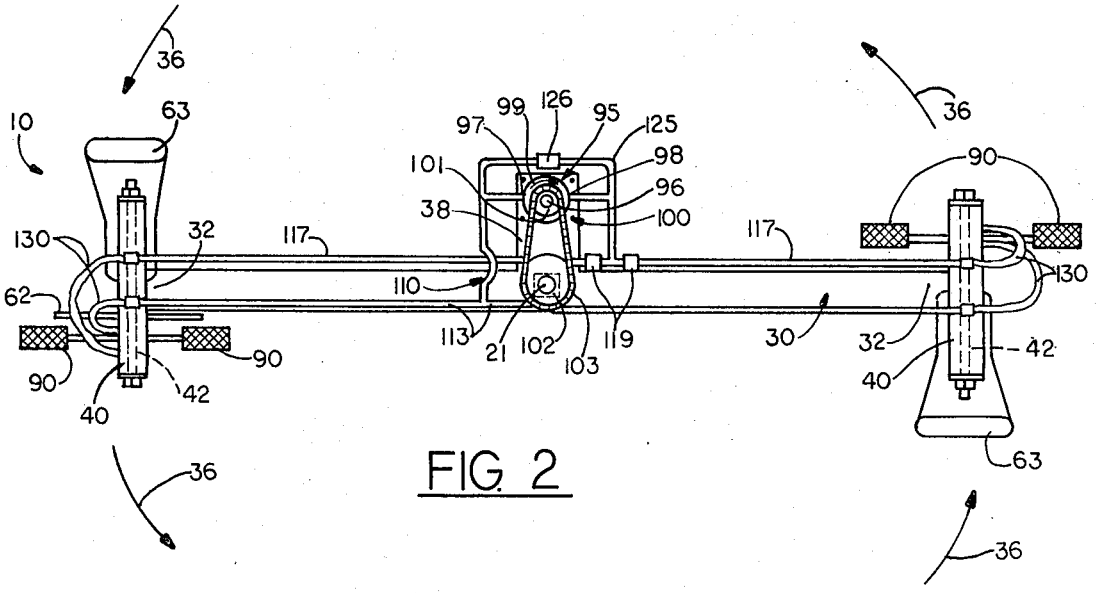
FIG. 2 is a top plan view of the device of FIG. 1.

Referring with greater particularity to the drawings, in FIGS. 1, 2, and 3 is shown a suspended cycle amusement device 10 embodying the principles of the present invention. Typically the device is utilized at a playground or the like having an earth surface 15.

The device has an upright column 20 having an upper portion 21 and a lower portion 22 which is upwardly adjacent to the surface 15. The upper portion is an upright cylinder and has a diameter substantially less than the horizontal dimension of the lower portion. The column is fixed in an upright disposition in any suitable manner, as by an extension 25 fixed to the lower portion and extended downwardly therefrom to anchor beneath the earth surface.

The device 10 has an arm 30 which extends across the upper portion 21 of the column 20. The arm has an upright, cylindrically tubular central portion 31, which is coaxially related to the upper portion of the column. The arm has opposite ends 32 spaced substantially equally from the column. The arm, typically, has a pair of braces extended individually from the ends diagonally to the lower end of the central portion. The central portion is provided with a pair of bearings 35 of any suitable construction spaced axially along and rotationally fitted to the upper portion of the column. The bearings thus mount the arm on the column for rotational movement about an upright axis coincident with the column, so that the opposite ends rotate in a horizontal circular path about the column, the path and the predetermined direction of rotation of the ends along the path being indicated by arrows 36. The upper portion of the column is substantially longer than the central portion of the arm and extends through it and somewhat upwardly thereof. The arm includes a motor bracket 38 extended horizontally from its central portion at a right angle to its end portions.

Each opposite end 32 of the arm has a horizontal cross bar 40 extending across it tangentially to the path 36. A lug extends downwardly from each end of each cross bar. A pivot bolt 42 extends through the pair of lugs of each cross bar parallel to the bar and is secured to the lugs in any suitable manner. The bolt thus defines a horizontal pivotal axis coincident with itself, and it is evident that the axis is adjacent to the arm and is tangentially related to the path.

The device 10 has a pair of cycle frames, indicated generally by the numeral 50. The frames are individually related to the opposite ends 32 of the arms 30 and extend downwardly therefrom. Each frame has an upper portion 51, which is mounted on the corresponding end of the arm, and has a lower portion 52. The upper portion terminates upwardly in a tube 55, best shown in FIG. 3, which circumscribes and is pivotally fitted to the corresponding bolt 42. Each frame is thereby pivotally interconnected to and suspended from the corresponding end of the arm in horizontally spaced relation to the column and rotates with such end about the column. As the upper portion of the frame rotates in the path 36, centrifugal force urges the lower portion of the frame to pivot relatively to the arm about the bolt 42 and outwardly from the column. The sensation of a person supported on and moving with the frame is thus similar to the sensation of a person riding a conventional bicycle in a turn.

Each frame 50 includes an elongated hanger 60 extended downwardly from the end of the corresponding tube 55 which is forwardly disposed in the direction of movement along the path 36. The hanger is rigidly connected to this tube and gravitationally assumes a substantially vertical position when the frame is not urged outwardly of the column 20 by centrifugal force. The length of the hanger is such that, when it is vertical, its lower end is spaced above the earth surface 15. Handlebars 62 are fixed centrally to each hanger and a seat 63 is fixed to each hanger downwardly of the handlebars by a suitable bracket. The handlebars and seat are of well-known construction as utilized in a bicycle and are adapted to support an operator on the frame for movement therewith about the column on the side of the hanger disposed rearwardly therefrom along the path. Each frame includes a pump mount 65 disposed on the lower portion 52 of the frame at the lower end of the hanger in a position relative to the seat corresponding to the position of the pedals of a bicycle relative to the seat thereof.

The device 10 has a pair of safety chains 70. Each chain has an end fixed to the upper portion 51 of one of the frames 50 and has an opposite end fixed to the adjacent end 32 of the arm 30. The corresponding length of the chain is such that it becomes taut when the frame pivots about the corresponding bolt 42 to a position 72, represented in dot-dash lines in FIG. 1, where the lower portion 52 of the frame attains a predetermined angle with the arm. The chain is thus a flexible tension element which interconnects the arm and such upper portion, and limits the pivotal movement of the frame outwardly of the column 20 and obviates any danger due to excessive deviation of the frames outwardly from the path 36 due to centrifugal force. The length of the chain and its points of attachment to the frame and the upper portion are such that, if the bolt or any other elements mounting the frame on the arm break, the frame together with elements mounted thereon remains suspended from the arm with the mount 65 a substantial distance above the earth surface in a position 74, also represented in FIG. 1 by dot-dash lines.

As shown, the device 10 has a pair of positive displacement hydraulic pumps 80 individual to the cycle frames 50 and mounted on and downwardly of the corresponding mount 65 in any suitable manner. Preferably each pump is constructed with a rotational input shaft 82 extended through it and projecting oppositely from it. The axis of the shaft is substantially normal to the corresponding hanger 60 and is substantially radially related to the column 20 when the hanger is vertical. Each pump has an inlet 83 and an outlet 84. Each pump is adapted to output hydraulic fluid under pressure at the outlet when its inlet is provided with hydraulic fluid and its shaft is rotated in a predetermined direction, which is indicated by the arrow 86 and which corresponds to the predetermined direction of rotation of the ends 32 of the arm 30 in the path 36.

The shaft 82 of each pump 80 is provided with a pair of pedals 90. The pedals are individually secured to the opposite ends of the shaft for rotation therewith and are disposed for pedaling in a bicycle-like manner by an operator at the corresponding seat 63. The pump 80 is thereby driven by the pedals. It is apparent that each shaft and the associated pedals define a pedal crank individual to and rotationally mounted on the lower portion 52 of the corresponding frame 50, the crank being connected in driving relation to the corresponding pump and disposed in a position for pedaling by an operator supported by such seat.

The device 10 has a positive displacement hydraulic motor 95 mounted on the bracket 38 of the arm 30 for rotation with the arm about the column 20. The motor has a rotational output shaft 96 which extends upwardly from the bracket above the central portion 31 of the arm in axially parallel relation to the upper portion 21 of the column. The motor has a first hydraulic connection at which the hydraulic fluid pressurized by one or both of the pumps 80 is supplied to the motor as subsequently to be described. The motor has a second connection at which fluid exits the motor. The motor is adapted, when so supplied with pressurized fluid, to rotate its output shaft in a predetermined direction, indicated by the arrow 99 in FIG. 2.

The device 10 has a mechanical drive mechanism 100 which connects the shaft 96 and the column 20 so that, when the motor 95 is supplied with pressurized fluid as just described, rotation of the output shaft rotationally drives the arm 30 about the column in the direction indicated by the arrows 36. The mechanical drive includes a driving sprocket 101 fixed on the output shaft for rotation therewith and a stationary sprocket 102 concentrically mounted on the upper portion 51 of the column and fixedly connected thereto in vertical alignment with the driving sprocket. These sprockets are circumscribed by an endless chain 103.

Figure 4:
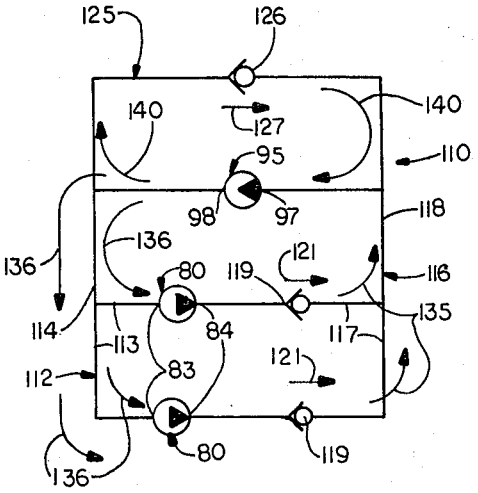
FIG. 4 is a schematic diagram of a hydraulic system utilized in the device.

The pumps 80 and motor 95 are connected by a hydraulic conduit system, indicated generally by the numeral 110. This system hydraulically connects the pump and the motor so that the motor shaft 96 is rotationally motivated when one or both of the pumps is motivated by the corresponding pedals 90. The pedals thus motivate the arm 30 to rotate about the column 20. The system has a first conduit 112 which has a pair of branches 113 individually connected to the pump inlets 83 and has a branch 114 connected to the second connection 98 of the motor. The first conduit thus connects the inlets in parallel to the second connection. The system has a second conduit 116 having a pair of branches 117 individually connected to the pump outlets 84 and a branch 118 connected to the first connection 97 of the motor. The second conduit thus connects the outlets of the pumps in parallel to the first connection and conducts pressurized fluid from either one of the pumps to the first connection when the motor is being motivated by the pump to drive the arm 30. The system has a pair of back pedal preventing check valves 119. Each valve is disposed in one of the branches 117 connected to the outlets and is constructed in a well-known manner to allow pressurized fluid to flow in a direction indicated by the arrow 121 through the second conduit from the outlet to the motor and to prevent flow of fluid toward the outlet. As best seen in FIG. 4, these check valves are individual to the pumps and each is disposed between the outlet of the corresponding pump and the outlet of the other pump.

The system 110 has a third conduit 125 which, as best shown in FIG. 4, connects the first conduit 112 and the second conduit 116 and, therefore, connects the first connection 97 and the second connection 98 of the pump 80. The system has a free wheel check valve 126 disposed in the third conduit. This check valve allows fluid to flow through the conduit in a direction indicated by the arrow 127 from the second connection to the first connection and prevents flow in the opposite direction.

As shown in FIGS. 1, 2, and 3, each of the branches 113 and 117 of the conduit system 110 extends along the arm 30 away from its central portion 31 and extends from the arm downwardly along one of the hangers 60 of the cycle frames 50. Each branch has a flexible hose 130 adjacent to the pivot bolt 42 and extended between the arm and the frame to accommodate the above described relative pivotal movement therebetween.

Since the drive between the pedals 90 and the arm 30 is hydraulic, except for the mechanism 100, this drive is mechanically efficient, and requires little maintenance although vigorously used and subject to the weather. Further, there is little danger due to clothes or portions of the body being caught in the drive since the only externally accessible moving parts are those of the mechanism which is at the top, central portion of the device 10, the portion thereof least accessible to an operator at one of the seats 63.

OPERATION

The operation of the described embodiment of the subject invention is believed to be clearly apparent and will be briefly described at this point. When the pedals 90 of one of the frames 50 are pedaled, the corresponding pump 80 supplies hydraulic fluid under pressure to the motor 95 through the second conduit 116, as indicated by the arrows 135 in FIG. 4. The arm 30 is thereby motivated to rotate about the column 20 as before stated. The fluid returns to the pump through the first conduit 112, as indicated by the arrows 136. If the pedals of the other frame are pedaled simultaneously with the pedals of the one frame, fluid from both of the pumps flows together through the branch 118 to the motor so that the arm is motivated by both pumps. However, if only the pedals corresponding to one pump are being pedaled, flow through the branch 117 corresponding to the other pump is prevented by the corresponding back pedal prevention check valve 119. Therefore, under these conditions, the shaft 82 of such other pump is not rotationally driven together with the pedals fixed thereto, in a direction opposite the direction 86. When either or both pumps are being motivated by the pedals and pressurized fluid is supplied to the second conduit 116, such fluid cannot bypass the motor through the third conduit 125 because of the check valve 126.

It is evident that substantial inertial energy is stored in the rotatable elements of the device 10 when these elements are rotating about the column in the direction 36. It is also evident that, when these elements are rotating and the pedals 90 are not being pedaled, this energy urges these elements to continue to rotate in this direction and to drive the motor 95. As is well known with positive displacement hydraulic motors, when the motor is driven, it acts as a pump and supplies hydraulic fluid under pressure at its second connection 98. This fluid is permitted to flow, as indicated by the arrows 140, by the free wheel check valve 126 from the second connection of the motor to its first connection 97. The pump 80 is thereby bypassed so that the pedals 90 are not forced to rotate when the rotatable elements of the device are rotating by their inertia. It is evident that fluid friction from such flow through the third conduit and the check valve therein effectively and gradually dissipates the inertial energy of the rotatable elements of the subject suspended cycle amusement device 10.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A suspended cycle riding device comprising

A. a column fixed in an upright disposition and having an upper portion;

B. an arm extended substantially horizontally from the upper portion and mounted thereon for rotation about the column;

C. a cycle frame pendantly supported on the arm for rotation with the arm about the column;

D. support means mounted on the frame for supporting an operator for movement therewith;

E. pedal means mounted on the frame for pedaling by an operator at the support means; and F. drive means for rotationally driving the arm about the column with the frame moving in a circular orbit thereabout, the drive means including a hydraulic pump mounted on the frame in driven relation to the pedal means, a hydraulic motor mounted on the arm for rotation therewith and having a rotational output shaft, hydraulic conduit means for hydraulically connecting the pump and the motor so that the shaft is rotationally motivated by the pump, and means connecting the shaft and the column for rotating the arm about the column when the shaft is motivated by the pump.

2. The device of claim 1 wherein the frame is pivotally mounted on the arm for movement about a horizontal axis adjacent to the arm and substantially tangentially related to the circular orbit, and the conduit means includes a flexible conduit adjacent to such axis and extending between the frame and the arm.

3. A suspended cycle riding device comprising:

A. an erect column having an upper portion and a lower portion,

B. means engaging such lower portion for fixing the column in an upright disposition, C. a substantially horizontal arm extended across such upper portion, the arm having opposite ends spaced from the column and a central portion, D. bearing means mounting the central portion of the arm for rotational movement of the arm about an upright axis generally coincident with the column so that each such opposite end rotates in a circular path about the column, E. a pair of cycle frames individually suspended from the opposite ends for rotation with the arm about the column, each frame having an upper portion mounted on the corresponding opposite end of the arm and a lower portion, F. a pair of pedal cranks individually rotationally mounted on the lower portions of the frames, G. a pair of operator support means individually mounted on the frames for supporting an operator for movement with each frame in a position to pedal a respective crank, H. a pair of hydraulic pumps individually mounted on the frames and connected in driven relation to their respective cranks, I. a hydraulic motor mounted on the arm for movement therewith, J. conduit means hydraulically connecting the pumps to the motor for motivating the motor from either one of the pumps when the corresponding crank is pedaled, and K. means for mechanically connecting the motor to the column so that the arm is rotationally driven thereabout by the motor.

4. The device of claim 3 wherein the device further comprises means interconnecting the upper portion of each frame to the corresponding end of the arm for pivotal movement of the lower portion of the frame relative to the arm and outwardly and inwardly of the column about a substantially horizontal axis generally tangential to the corresponding path.

5. The device of claim 4 further comprising a pair of flexible tension elements individually interconnecting the upper portion of each frame and the arm, the length of each element being such that the element becomes taut, when in such pivotal movement the lower portion of the corresponding frame attains a predetermined angle with the arm, said element thereby limits the movement of the frame outwardly of the column to such angle.

6. The device of claim 5 wherein the arm is inertially rotatable in the predetermined direction thereof together with the frames so that the motor is driven by the arm by stored inertial energy when the pedals are not being pedaled, and wherein the conduit means further comprises A. a third conduit connecting the second connection of the motor and the first connection thereof, and B. free wheel check valve means disposed in the third conduit for preventing flow of fluid therein from the first connection to the second connection and for allowing flow of fluid through the third conduit from the second connection to the first connection when the motor is so driven by the arm, thereby dissipating the inertial energy of the arm and the frames.

7. The device of claim 3 wherein the arm is rotatable in a predetermined direction when driven by the motor; wherein the motor and each of the pumps are of positive displacement construction; wherein each pump has an outlet for hydraulic fluid which is pressurized by the pump when the pump is driven by the corresponding crank with the crank rotating in a predetermined direction corresponding to the predetermined direction of the arm; wherein each pump has an inlet through which hydraulic fluid is supplied to the pump when the crank rotates in such predetermined direction; wherein the motor has a first connection, at which such pressurized fluid enters the motor when the motor is motivated by either one of the pumps to drive the arm in the predetermined direction thereof, and has a second connection at which hydraulic fluid exits the motor when the motor is so motivated; and wherein the conduit means comprises:

A. a first conduit connecting the inlets of the pumps in parallel to said second connection, B. a second conduit connecting the outlets of the pumps in parallel to said first connection, and C. a pair of back pedal preventing check valve means individual to the pumps, each such means being disposed in the second conduit between the outlets of the pumps for allowing flow of pressurized fluid from such outlet through the second conduit to the motor when the crank corresponding thereto is pedaled and for preventing flow of pressurized fluid toward such outlet when such crank is not being pedaled and the crank corresponding to the other pump is being pedaled.

* * * * *